United States Patent [19]

Sizemore et al.

[11] 4,391,043

[45] Jul. 5, 1983

[54] KNIFE WITH REMOVABLE BLADES

[76] Inventors: Howard Sizemore, 26384 Couzens Rd., Madison Heights, Mich. 48071; Robert Bruner, 1730 Peavey Rd., Howell, Mich. 48843

[21] Appl. No.: 314,589

[22] Filed: Oct. 26, 1981

[51] Int. Cl.[3] ..... B26B 1/00

[52] U.S. Cl. ..... 30/330; 30/337

[58] Field of Search ..... 30/330, 331, 337

[56] References Cited

U.S. PATENT DOCUMENTS

| | | | |
|---|---|---|---|
| 300,356 | 6/1884 | Gardner | 30/337 |
| 515,045 | 2/1894 | von Bultzingslowen | 30/337 |
| 842,173 | 1/1907 | Carman | 30/337 |
| 939,091 | 11/1909 | Riggs | 145/2 A |
| 1,018,210 | 2/1912 | Segel et al. | 30/337 |
| 1,189,005 | 6/1916 | Seely | 145/2 A |
| 1,226,636 | 5/1917 | Brown | 30/337 |
| 1,273,025 | 7/1918 | Brongel | 30/337 |
| 1,361,021 | 12/1920 | Copeman | 30/337 |
| 1,813,723 | 7/1931 | Beaver | 30/337 |
| 1,998,188 | 4/1935 | Dunn | 30/337 |
| 3,121,952 | 2/1964 | Schohl | 30/331 |
| 3,783,509 | 1/1974 | Lake | 30/161 |

FOREIGN PATENT DOCUMENTS

| | | | |
|---|---|---|---|
| 469444 | 11/1950 | Canada | 30/337 |

*Primary Examiner*—James G. Smith
*Assistant Examiner*—J. T. Zatarga
*Attorney, Agent, or Firm*—John R. Benefiel

[57] ABSTRACT

A knife including a detachable blade which is readily released from the knife handle with a locking mechanism including a spring biased pivotally mounted locking plate formed with a locking tab mating with a recess in a knife blade tang.

To assemble the blade to the handle the tang is inserted into a knife handle socket and the locking plate tab moved into locking engagement with the tang. Depression of the locking plate rearend enables quick release for replacement or removal of the knife blade. A series of angled shoulders formed on the knife blade and the tang cooperate with corresponding angled surfaces on the handle components provide great rigidity of the blade in the handle.

9 Claims, 3 Drawing Figures

KNIFE WITH REMOVABLE BLADES

BACKGROUND DISCUSSION

The present invention concerns knives, and more particularly, a knife of the type having a blade affixed within a knife handle such as widely employed for sporting use in camping, hunting, fishing, etc.

It has heretofore been recognized that it would be very advantageous for such knives to have a means for replacing the knife blade such that a single handle may be adapted for multi-purpose use. There have heretofore been devised arrangements whereby the knife is releasably locked within the handle for the purpose of enabling such a readily removable blade, examples of such designs are shown in U.S. Pat. Nos. 3,900,950, 4,233,737 and 2,695,450, the latter Patent in the context of the knife and hatchet use of a single handle assembly.

It is highly desirable that in any such design that the knife blade be securely supported by the handle such that the handle may rigidly support the blade during use, resisting, without loosening, the stresses which may be imposed on the knife during its use.

A further quality in such design is that of simplicity and ease with which the locking mechanism may be manipulated by the user. It is highly undesirable that complicated or time consuming procedures be employed in changing or removing the blade.

A further highly desirable attribute of any such design is a smooth outer contour, free from projecting elements since such projections would tend to catch, and also would reduce the esthetic appeal of the particular design, an important factor in its marketability. Exposed recesses and cavities also tend to collect dirt and moisture nad make the knife more difficult to keep clean and rust-free.

Accordingly, it is an object of the present invention to provide a knife of the type having a detachable blade, in which the locking mechanism, while being readily manipulated to release the blade, insures that the blade is held with great rigidity when inserted in the knife handle.

It is another object of the present invention to provide such a detachable blade knife in which a locking mechanism is employed which is simple and trouble-free.

It is yet another object of the present invention to provide such a knife having a detachable blade in which the knife handle is configured with smooth outer contours having a high degree of esthetic appear free from projections or cavities.

It is still another object of the present invention to provide such a knife with a detachable blade in which the locking mechanism may be operated with a simple movement in order to release the knife blade for removal and replacement.

SUMMARY OF THE INVENTION

These and other objects which will become apparent upon the reading of the following specification and claims are achieved by a knife having a detachable blade with a forward cutting portion and a tang extending from the rear portion thereof which is adapted to be received with in a socket in a knife handle or holder. The socket is formed by a clearance space between the forward ends of locking plate and a guide and spacer plate mounted below the locking plate. A series of side plates located on either side of the locking plate and guide and spacer plate are assembled thereto to form the handle.

The locking palte is pivotly mounted intermediate its length against the bias of a spring acting on the rear-end of the locking plate urging it into the locking position. The locking plate has formed a tab on its forward end inwardly projecting such as to move into mating engagement with a recess formed into one side of the tang, located in registry therewith upon full insertion of the tang into the handle socket.

The knife is rigidly supported by mating angled shoulders formed adjacent the tnag on the knife blade and corresponding angled shoulders formed on the forward end of the locking plate and the guide and spacer plate respectively.

Another angled surface formed on the rear-end of the tang mates with an angled shoulder formed adjacent a clearance on the guide spacer plate, which angled surfaces together provide support and rigidity to the mounting of the knife blade in the handle.

The sandwiched plate construction of the handle and the design of the locking mechanism provide smooth exterior contours.

To release, only a slight depression of the rear upper edge of the locking plate is necessary to release the blade and to hold the locking plate in its release position for reinsertion of a replacement blade. Cut outs on the side plates and grips adjacent to the rear end of the locking plate enables the depression of the locking plate.

The angled shoulders are relatively widely spaced outboard contributing significantly to the rigidity of the design.

DETAILED DESCRIPTION

Figures 1, 2, 3:
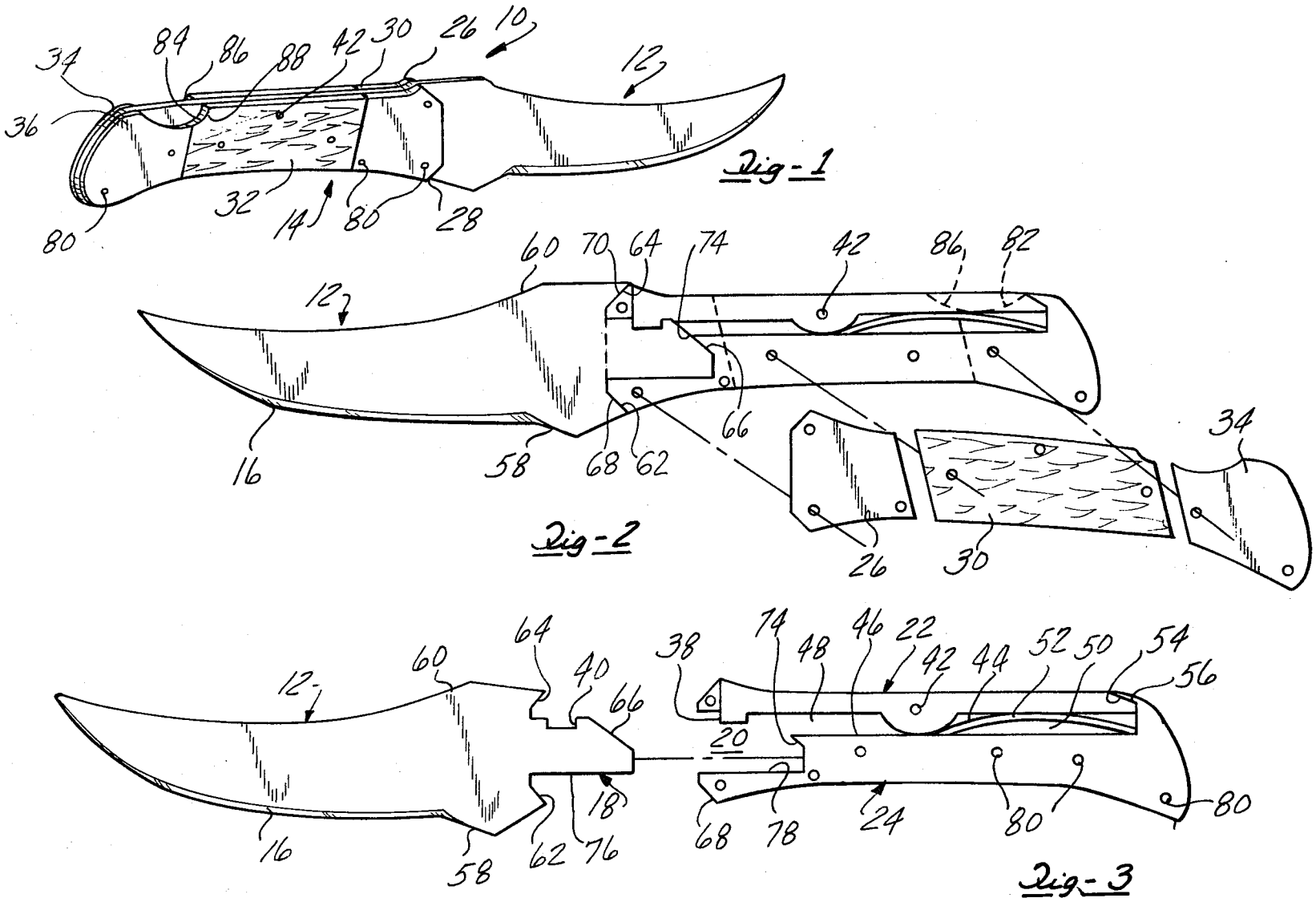
FIG. 1 is a perspective view of an assembled knife handle and blade according to the present invention.
FIG. 2 is a view of the knife shown in FIG. 1 with the side plates removed to reveal the details of a locking mechanism.
FIG. 3 is an exploded view of the knife shown in FIGS. 1 and 2 showing the knife blade detached from the knife handle.

In the following detailed description certain specific terminology will be employed for the sake of clarity and a particular embodiment described in accordance with the requirements of 35USC112, but it is to be understood that the same is not intended to be limiting and indeed should not be so construed inasmuch as the invention is capable of taking many forms and variations within the scope of the appended claims.

Referring to the drawings and particularly FIG. 1 the knife 10 according to the present invention includes a blade 12 and a handle 14 each of which is separable from each other by operation of a locking mechanism. The blade 12 is elongated and includes a sharpened cutting edge 16 extending to the point of the knife blade 12, and also includes a tang 18 extending from the rear end of the knife blade 12. The tang 18 is adapted to be inserted into a knife socket generally indicated at 20 in FIG. 3 slidably received in a space intermediate forward ends of a locking plate 22 and an elongated guide-spacer plate 24 mounted in alignment with each other an sandwiched between a series of side plates. These include a pair of forward side plates 26 and 28, 28 a pair of grips, 30 and 32, and a pair of butt-plates 34 and 36.

The socket 20 is defined by the space intermediate of the forward end of locking plate 22 and the guide-spacer plate 24 and on either side of the side plates 26 and 28. The tang 18 is designed to be engaged with a locking tab 38 extending inwardly from the forward end of the locking plate 22 and, as shown, is of a generally rectangular configuration.

The tang 18 is formed with a similarly rectangularly shaped recess 40 extending into one side thereof, located such that upon a full insertion of the tang 18 into the socket 20 the locking tab 38 and the recess 40 are in registry with each other.

The locking plate 22 is pivotally mounted intermediate its length by a pivot pin 42 extending through the locking plate 22 and into each of the grips 30 and 32. The locking plate 22 is formed with an arcuate protuberance 44 concentric with the pivot pin 42, and immediately tangent thereto is a straight side 46 formed on the guide-spacer plate 24 against which the protuberance 44 rocks.

Clearance spaces 48 and 50 are provided which accomodate the rocking or pivoting motion of the locking plate 22, which are of sufficient size to allow movement of the locking tab 38 into and out of the recess 40.

In the rear clearance space 50 is disposed a leaf spring 52 which acts to spring bias the locking plate 42 into the locking position, i.e., a counterclockwise rotated position, as viewed in FIGS. 2 and 3.

The locking travel of the locking plate 22 under the influence of the leaf spring 52 is limited by a catch projection 54 formed on the guide-spacer plate 24 and adapted to engage an end surface 56 at the rear end of the locking plate 22 in a position corresponding to the locked position.

The knife blade 12 is formed with outwardly flaring sides at the top and bottom 58 and 60 which thence converge to a pair of inwardly and rearwardly angled shoulders 62 and 64.

An additional angled shoulder 66 is provided on the end of the tang 18. The shoulders 62 and 64 come into abutment with corresponding angled shoulders 68 and 70 formed on the forward end of the guide-spacer plate 24 and fixed the side plate 28, respectively, while the angled shoulder 66 moves into abutment against a corresponding angled shoulder 74 formed on the guide-spacer plate 24 immediately adjacent the end of the socket 20. The resulting three surface securement of the blade securely resists loosening of the blade from the forces generated during use.

The angled shoulders provide a secure support notwithstanding dimensional variations occurring in the manufacture of the device.

The underside 76 of the tang 18 is positioned immediately above a straight sided corresponding surface 78, such that a four point engagement is provided of the tang with the socket, and the angled surfaces ensuring tight engagement therebetween.

The locking plate 22 and the guide-spacer plate 24 are of the same thickness such as to be sandwiched between a series of side plates including the forward side plates 26 and 28, grips 30 and 32, and the buttplates 34 and 36 with a series of rivets or pins 80 securing the same together to form the knife handle assembly.

The buttplates 34 and 36 are provided with arcuate cutouts 82 and 84 respectively which enable finger depression of the rear-end of the locking plate 22 by the user. Radiused cutouts 86 and 88 of the grips 30 and 32 are also provided for the same purpose.

Accordingly, it can be seen that the locking mechanism, according to the present invention, achieves the above recited objects, in that a relatively simple mechanism which may be readily manipulated with only a slight movement provides reliable instant release of the knife handle, while at the same time providing rigid support of the knife blade, by the mating series of angled shoulders acting between the tang and the knife handle socket.

The mating tab and recess provides a very secure end retention of the blade in the handle.

The exterior lines of the knife and blade assembly are clean with a high degree of esthetic appeal, and which is free from projections or cavities, further contributing to the serviceability of the design.

Variations in the specifics described are of course possible within the scope of the following claims.

We claim:

1. A knife comprising:

an elongated blade comprising a cutting end having a sharpened edge extending along at least one side and a tang formed with sides extending generally away from said cutting end, and also having a recess extending into one side thereof, said tang formed at the end thereof remote from said blade cutting end with an angled surface;

said blade including a pair of inwardly and forwardly angled shoulders on either side of said tang;

a handle including grip portions and a socket at a forward end adapted to slidably receive said tang, said socket including a fixed angled surface aligned with said tang and adapted to mate with said tang angled surface upon full insertion of said tang in said handle socket;

and also including a pair of angled shoulders on said forward end of said handle adjacent said socket, and configured to be brought into mating engagement with said angled shoulders on said blade with said tang fully inserted in said socket;

an elongated locking plate and a pivotal mount pivotally mounting said locking plate to said handle at a point intermediate the length of the locking plate to allow limited pivoting motion between locking and releasing positions; said locking plate including a forward locking end and a rear-end, said locking end on a side adjacent to said socket, and formed with a locking tab configured to be moved downward into mating relationship with said recess in said tang, with said tang fully inserted in said socket;

spring bias means urging said locking plate to said locked position;

whereby said blade may be released by pivoting said locking plate rear-end to release position against the resistance of said spring bias means.

2. The knife according to claim 1 wherein said locking plate includes a radiused protuberance, intermediate its length, concentric with said pivotal mount, and further including an elongated lower guide-spacer plate mounted to said handle aligned with said locking plate and of the same thickness, having a straight side extending parallel to said handle length and adjacent to said protuberance, and clearance spaces therebetween forwardly and rearwardly of said pivotal mount to enable said pivoting motion of said locking plate.

3. The knife according to claim 2 wherein said spring bias means comprises a leaf spring interposed in said clearance space to the rear end of said handle, engaging said side of said guide-spacer plate and said adjacent end of said locking plate.

4. The knife according to claim 3 wherein said guide-spacer plate further includes a catch portion extending to overlie the end of said locking plate adjacent said handle rear-end to limit said pivoting motion thereof under the influence of said leaf spring to that corresponding to said locked position.

5. The knife according to claim 4 wherein said handle socket is formed in part by a clearance cutout at the forward end of said guide-spacer plate and also including a series of said plates mounted on each side of said guide-spacer plate, said socket being formed in part by the interior adjacent surfaces of said side plates.

6. The knife according to claim 5 wherein said series of side plates includes a pair of butt plates mounted alongside the rear-ends of said locking plate and said guide-spacer plate, and wherein said butt plates each have an arcuate cutout adjacent said rear end of said locking plate to enable releasing pivoting by depressing said locking plate.

7. The knife according to claim 5 wherein said series of side plates includes a pair of grips located alongside the intermediate portion of said locking plate and said guide-spacer plate and wherein said locking plate is pivotally mounted by a pivot pin passing through said locking plate and each of said grips.

8. The knife according to claim 5 wherein said knife blade includes an outwardly flaring upper and lower sides immediately forward of said angled shoulders.

9. The knife according to claim 1 wherein said locking tab comprises a rectangular projection and wherein said recess in said tang is formed in a corresponding rectangular shape.

* * * * *